United States Patent [19]

Watkins

[11] Patent Number: 5,025,520

[45] Date of Patent: Jun. 25, 1991

[54] COMBINED TOOL AND METHOD FOR USING SAME

[76] Inventor: William C. Watkins, 3910 Penrod Dr., Phenix City, Ala.

[21] Appl. No.: 381,363

[22] Filed: Jul. 18, 1989

[51] Int. Cl.[5] ..... B26B 11/00

[52] U.S. Cl. ..... 7/163; 33/530

[58] Field of Search ..... 7/158, 163, 164; 33/530, 534

[56] References Cited

U.S. PATENT DOCUMENTS

| | | | |
|---|---|---|---|
| 1,292,969 | 1/1919 | Sturgis | 7/163 X |
| 2,172,368 | 9/1939 | Eby | 33/530 |
| 2,421,754 | 6/1947 | Little et al. | 33/530 |
| 2,717,453 | 9/1955 | Wildt | 33/530 |
| 2,952,025 | 9/1960 | Johnson | 7/163 |
| 3,740,779 | 6/1973 | Rubricuis | 7/163 |
| 4,581,782 | 4/1986 | Riley | 7/164 X |

*Primary Examiner*—James G. Smith

*Attorney, Agent, or Firm*—Evensón, Wands, Edwards, Lenahan & McKeown

[57] ABSTRACT

A combination tool includes a retractable knife and a pitch gage which provides pitch measurements directly in terms of inches of vertical rise per foot of horizontal distance. The tool can also be provided with indicia to permit vertical and horizontal alignment of shingles, as well as uniform overlapping of boards, and a liquid level device. The tool has a casing with a storage compartment for holding extra knife blades or different types of knife blades. A method is disclosed which permits the tool to be used for obtaining uniform shingle overhang, horizontal and vertical alignment of the shingles, and uniform overlap of siding boards.

14 Claims, 5 Drawing Sheets

COMBINED TOOL AND METHOD FOR USING SAME

BACKGROUND OF THE INVENTION

The present invention relates to a new combination tool which includes a roof pitch gage and a method of using same and, more particularly, to a combination tool and a method of use which allows a roofer or other user to know immediately the pitch of a roof or other inclined surface without actually having to read the specific number of degrees involved and thereafter calculate the pitch and also to align shingles for uniform overlap and the like.

In the past, it has been conventional to determine the rise or pitch of the roof by calibrating the pitch in degrees. When the degree is established, it is then transposed into inches of rise per foot, e.g. 9.5° would translate into "2 and 12" (2 inches of rise vertically for every 12 inches horizontally). Such a gage is obviously not convenient for a roofer or an unexperienced person to use and further requires that the roofer carry an extra tool to gage the pitch of the roof.

Heretofore, manufacturers of tools used for roofing have not provided tools which are also capable of assuring uniform shingle overhang, vertical alignment of shingle tab slots and horizontal alignment of each course of shingles even for hip and ridge-lap shingles. Nor have these manufacturers provided a single, simple tool with other features such as a level and pitch gage so that the tool can be used in place of a standard level and thereby eliminate another separate tool.

It has, of course, been known to attempt to combine functions within a single tool to avoid the need to carry multiple tools as shown, for example, in U.S. Pat. No. 4,581,782. There, a hammer is described which contains both a vertical and a horizontal level in the handle so that the carpenter may level horizontally each board to be nailed in place just prior to driving the nail.

Similarly, U.S. Pat. No. 2,952,025 shows the combination of a cutting knife and a tape measure in the handle to facilitate measuring cuts, whereas U.S. Pat. No. 3,740,779 discloses a surgical tool which comprises a surgical scalpel having a scalpel blade at one end and a series of metered markings on the shaft so as to make longitudinal measurement as well as a device for measuring the circumferential diameter of an orifice or mouth of a tube or duct at the other end of the tool.

However, up to the present time, no one has yet evolved a satisfactory tool which provides for easy measurement of pitch while, at the same time, provides a versatile multiple tool also having other functions.

Devices for measuring pitch are known, but these devices are relatively complicated and impractical for use in roofing work. For example, U.S. Pat. No. 2,172,368 discloses a pitchometer for determining the correctness of the surfaces of propeller blades. However, such a device requires the use of recording paper to chart the profile of the blade surface. Likewise, U.S. Pat. No. 2,421,754 discloses a pitchometer for use in manufacturing propellers which again uses a relatively cumbersome gage rod 28 and protractor plate 32 which is impractical for use in roofing work and other construction work requiring mobility and flexibility.

Furthermore, the tools presently available for, in particular, roofing applications are not adequate to assure with one simple and relatively inexpensive tool a uniform shingle overhang or perfect vertical alignment of shingle tab slots or perfect horizontal alignment of each course of shingles. Moreover, no tool presently available performs the foregoing functions, as well as direct pitch readings, and also eliminates the need for a chalk line to maintain a straight run of hip and ridge-lap shingles.

SUMMARY OF THE INVENTION

It is an object of the present invention to overcome the foregoing problems and disadvantages encountered in the prior art with respect to a practical pitch measuring gage useful for roofing applications combined in a knife tool which permits accurate and easy installation of shingles and other building materials.

It is yet another object of the present invention to provide a pitch gage which can be utilized in a tool having other functions so as to maximize the versatility of the tool.

It is yet another object of the present invention to provide a roof pitch gage which eliminates the need for the worker to calculate the rise o pitch of the roof from a degree measurement, thereby simplifying the worker's task and allowing the work to proceed more efficiently.

It is still a further object of the present invention to provide a versatile combination tool which can be used a assure uniform roof shingle overhang, perfect vertical alignment of shingle tab slots, and horizontal alignment without the need for chalk lines.

A feature of the present invention is the incorporation of the novel pitch gage in a knife tool having a retractable cutting blade and a storage compartment for extra blades so that the user can use different types of blades, e.g. straight edge blades or hook-bill blades.

Another aspect of the present invention is the use of a pitch gage which is mounted conveniently on the handle of the knife tool so as to be easily readable and constructed in a manner which permits a direct reading of pitch.

Still another feature of the present invention is the incorporation of a fluid level in the handle to further increase the versatility of the tool.

These and other features, objects and advantages of the present invention are accomplished by the utilization of a pitch gage in a tool comprising a pendulum rotatable about a pin in a casing arranged in the tool handle with a pendulum indicator in the form of a fluorescent arrow on the pendulum and a raised pitch scale and numbers on the gage casing so that the worker can easily observe and directly read the correct figure without the need to convert degrees to inches of rise per foot.

The knife tool can also have a compartment for blade storage to further increase the versatility of the tool and include a liquid level for indicating deviation from the horizontal and/or vertical.

The tool can also be provided with a lip on the casing to engage or hook a shingle edge or side for obtaining vertical alignment of shingle tab slots and horizontal alignment of each course of shingles without the need for chalk lines. In addition, the tool body can be provided with lines which serve as reference lines for aligning the shingles and maintaining a straight run of shingles.

In operation, according to the method of the present invention, the base of the knife tool is placed flat against a facia board allowing a shingle edge stop to protrude or extend above the level or edge of the roof. The base is placed on the facia board at the rake end of the roof. The end of the starting course shingle is extended over the edge of the roof until the edge of the shingle comes into contact with the shingle edge stop 11 of the tool. Two or more measurements are similarly made on the long or eave side of the roof to ensure a uniform shingle overhang. All succeeding starter course shingles are laid in the same manner. For example, if a one-inch overhang is the accepted measurement for shingle overhang, a shingle edge stop on the knife can be preset at one inch.

To assure perfect alignment of all succeeding vertical tab slots after the first course has been laid, the starter course is used as a guide. The lip of the tool casing is hooked on the left edge of the tab slot of the lower shingle or the first course shingle. The next or second course shingle is slid on top of the first course shingle until the left edge of the top shingle tab edge lines up with, e.g., a six inch line on the tool. This assures that the top shingle vertical tab slot is perfectly centered on the bottom shingle.

It may be desired that, for example, five inches of the bottom of each shingle will be exposed to the weather after overlapping courses are applied. To assure perfect horizontal alignment of each course of shingles, the lip on the casing of the knife tool is hooked on the bottom edge of the lower shingle and the bottom edge of the top shingle is aligned with a five inch line on the tool. By doing this, the need for old-fashioned chalk lines is eliminated.

In the case where hip and ridge lap shingles are applied, each succeeding shingle has an exposed overlap of, for example, five inches after the first hip or ridge lap shingle has been centered and nailed in place. By hooking the lip of the knife tool casing on the bottom edge of the second shingle and aligning the bottom edge at both sides of the next shingle with the five inch line on the tool, the five inch overlap is maintained and a perfectly straight run of hip or ridge lap shingles will result, again eliminating the need for a chalk line.

The knife tool according to the present invention can be equipped with a retractable cutting blade and storage compartment for extra blades. Either a straight edge or a hook bill blade may be used. A finger slot in the casing allows the user to exert uniform and constant pressure while cutting. In this connection, the retractable cutting blade tool is not restricted to cutting shingles but can also be used for other jobs that require a sharp knife such as sheet rock, carpet, wall paper, floor tile and the like.

To determine the pitch of a roof, the top edge of the tool is placed flat against the roof or shingles. A pitch gage shows the pitch of the roof in inches per foot. In particular, the pitch gage according to the present invention is designed and calibrated to show the slope or pitch of a roof in inches of rise per foot directly rather than in degrees. The number of inches of vertical rise of the roof over a horizontal distance of 12 inches, e.g. a "6 and 12 roof" has a slope or pitch that rises 6 inches over a 12 run. The pitch gage thus eliminates the need of knowing the actual degrees of pitch by instantly showing the user the inches of rise per foot and thereby eliminating the need to calibrate the same.

When utilizing the tool for other purposes, such as applying horizontal lap-siding, each succeeding board overlaps the lower board by a certain amount, for example ¾ inch or 1 inch. By scribing two lines on the roofing tool of the present invention, say, for example, one ¾ inch forward of the lip and one 1 inch forward of the lip, there is provided a structure for measuring and marking the overlap required. After the first board has been nailed in place the lip is hooked on the top edge of the board with the nose pointing downwardly. By using either the ¾ inch line or the 1 inch line, the worker can mark where the bottom edge of the next board is to be positioned.

BRIEF DESCRIPTION OF THE DRAWINGS

These and other features, objects and advantages of the present invention will become more apparent from the following detailed description of a presently preferred embodiment when taken in conjunction with the accompanying drawings wherein:

FIG. 6 is a schematic view illustrating how the knife tool or FIG. 1 is used to center a top shingle vertical tab slot on a bottom shingle;

DETAILED DESCRIPTION OF THE PREFERRED EMBODIMENT

Figure 1:
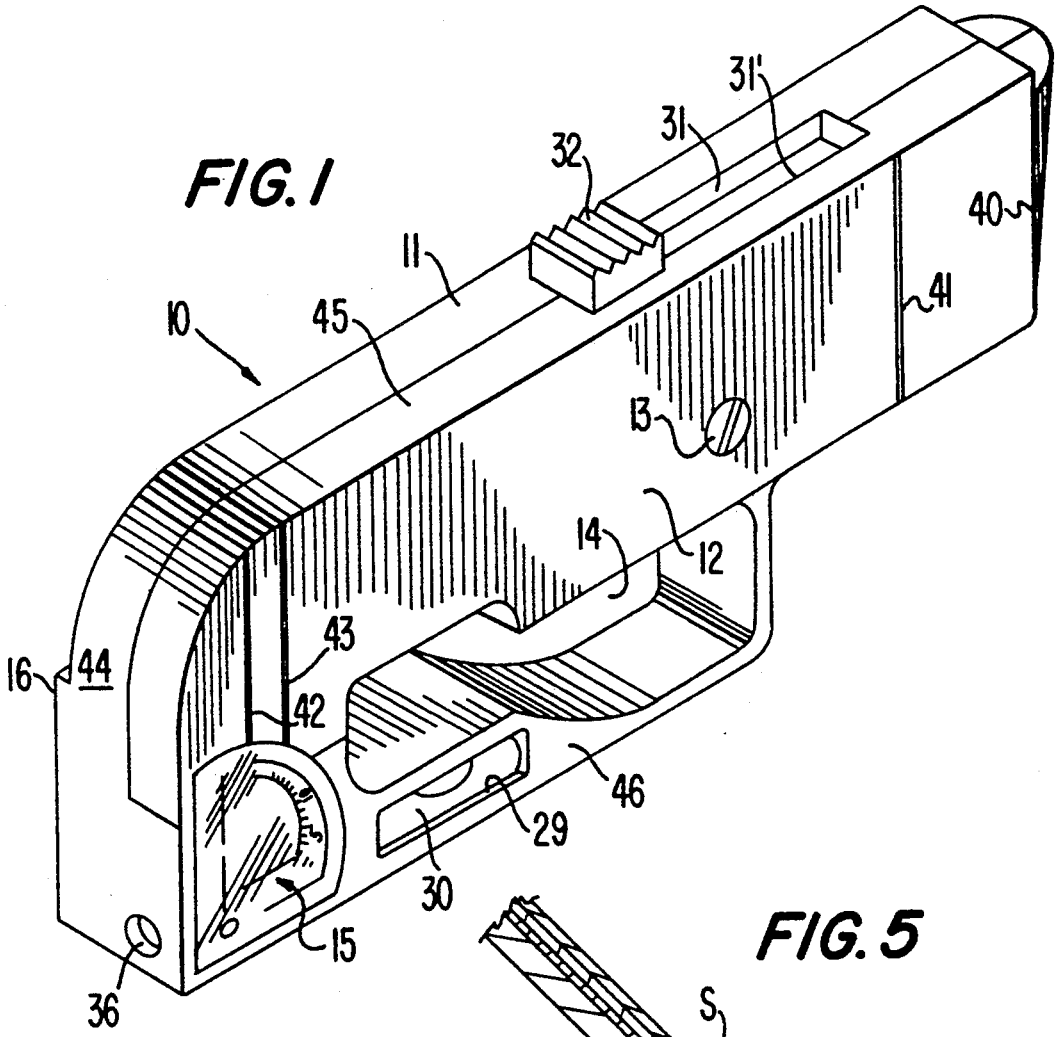
FIG. 1 is a perspective view of the knife tool of the present invention in its assembled state.

Referring now to the drawings and, in particular, to FIG. 1 there is shown a knife tool in accordance with the present invention designated generally by the numeral 10. The major components of the knife tool 10 comprise a main body 11 which is joined to a removable cap 12 by a screw 13 or the like. The main body 11 can incorporate a finger slot 14 for gripping and pressure application by the worker and a pitch gage 15. The main body 11 also includes a lip 16 at its rearward end for a purpose to be disclosed more fully herein below. A blade slot 17 is defined between the cap 12 and the main body 11 at the forward end of the tool 10 so as to hold a blade 18 such as a straight edge blade or a hook bill blade in a manner in which the blade 18 can be retracted toward and projected forwardly from the nose 19 of the tool 10.

The pitch gage 15 shows the slope or pitch of a roof directly in inches of rise per foot. The pitch is calibrated directly to show the number of inches of vertical rise of the roof over a horizontal distance of 12 inches. Thus, the pitch gage 15 eliminates the need for the worker to know the actual degrees of pitch by instantly showing the worker the inches of rise per foot.

Figure 3:
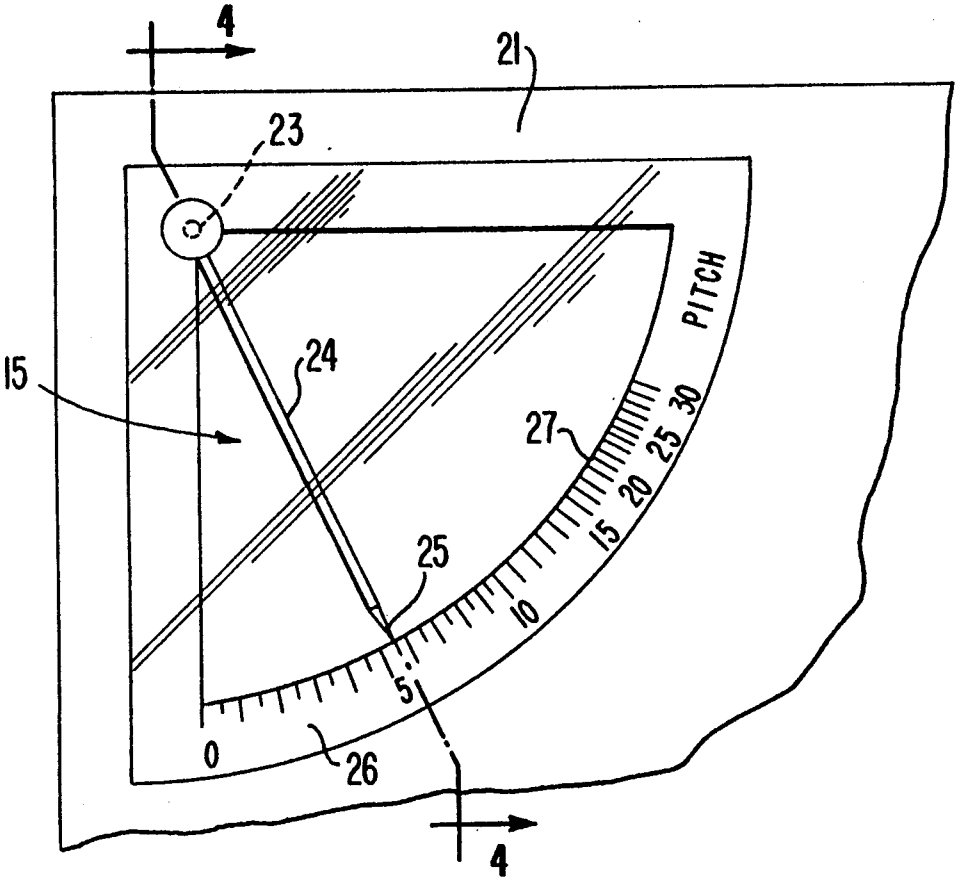
FIG. 3 is a front elevational view of the pitch gage incorporate in the knife tool of FIG. 1.

The pitch gage 15 is received in a recess 20 in the main body 11 and comprises a plastic casing 21 with a clear plastic face 22 so that the worker can observe the reading of the gage 15 therein. A pendulum pin 23 is provided in the casing 21 about which an indicator 24 in the form of a pendulum can rotate freely when the tool 10 is inverted and placed on the roof surface so that gravity causes the indicator 24 to point straight down. At the end of the pendulum indicator 24 there is provided a fluorescent arrow 25 which is intended to cooperate with a raised pitch scale 26 on the housing which also has raised numbers 27 showing major gradations of pitch, e.g. 5, 10, 15 and so on. As illustrated in FIG. 3, the pitch gage 15 reads 5.5 inches of rise per 12 inches. It will be appreciated that a reading of 12 inches of rise per 12 inches is the same as a 45° pitch angle.

An extra blade receptacle 28 can be provided within the main body 11 as well as a liquid level cut out receptacle 29 for providing a horizontal level device 30 of a known type. A blade guide 31, 31' is provided on the main body 11 and on the cap 12, respectively. A thumb button 32 and blade holder 33 are provided between the cap 12 and the main body 11 to allow the blade 18 to be held and moved back and forth to a fixed position by the worker to the extent necessary by means of engagement between a projection 34 associated with the thumb button 32 and detents 35 in the main body.

The level 30 which can also be incorporated in the tool 10 of the present invention is, as previously noted, of standard construction and can be inserted into the cut-out receptacle 29 located at the bottom of the main casing 11 by means of a hole 36 drilled or machined through its rear portion and passing through the pitch gage receptacle 20 and into the level receptacle. The level 30 can be used in place of any standard 6 inch level. It can also be used by placing the base 37 on top of a longer straight edge (not shown) and thereby be used as a 2, 3, or 4 foot level.

The forward ends of the main body 11 and the cap 12 have a nose 38 with a blade slot 39 therebetween so that the blade 18 can be moved therebetween into and out of the tool 10 by pressing the thumb button 32.

A line 40, e.g. a six inch line near the front of the tool 10 and measured from the butt end 44 of the tool 10 can be permanently scribed in or affixed to the main body 11 and/or cap 12 for carrying out a method of aligning shingle vertical tab slots as hereinafter described. Another line 41, e.g. a five inch line measured from the butt end 44, on the main body 11 and/or cap 12 can be used for carrying out a method of horizontal alignment of each row of shingles as hereinafter described. Two other lines 42 and 43, representing, e.g. a ¾ inch line and a 1 inch line measured from the butt end 44 of the tool 10, are provided for carrying out a method of applying horizontal lap-siding as hereinafter described.

In use, the tool 10 of the present invention can be used to carry out the various measuring and cutting operations. To determine the pitch of a roof, the top edge 45 of the tool is placed flat against the roof or shingles. The pendulum indicator 24 which swings freely about pivot 23 in the pitch gage 15 will show the number of inches of vertical rise of the roof over a horizontal distance of 12 inches. For instance, as shown in FIG. 3 the pitch gage reads 5.5 inches of rise per 12 inches of run. Thus, the pitch gage 15 eliminates the need for the roofer to know the actual degrees of pitch by instantly showing the user the inches of rise per foot.

Figure 5:
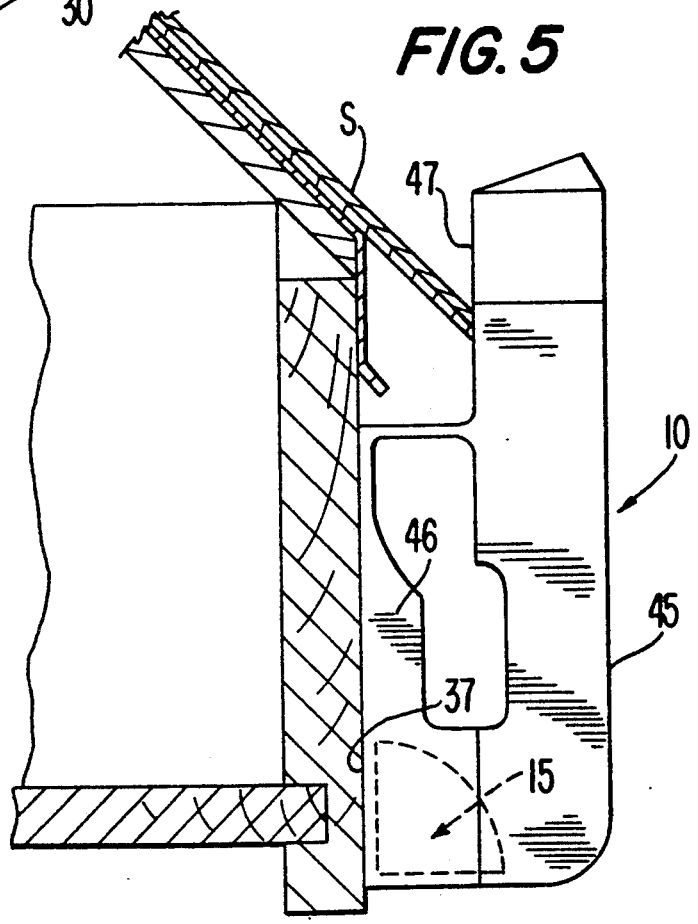
FIG. 5 is a schematic view illustrating how the knife tool of FIG. 1 is used to assure uniform shingle overhang.
Figure 2:
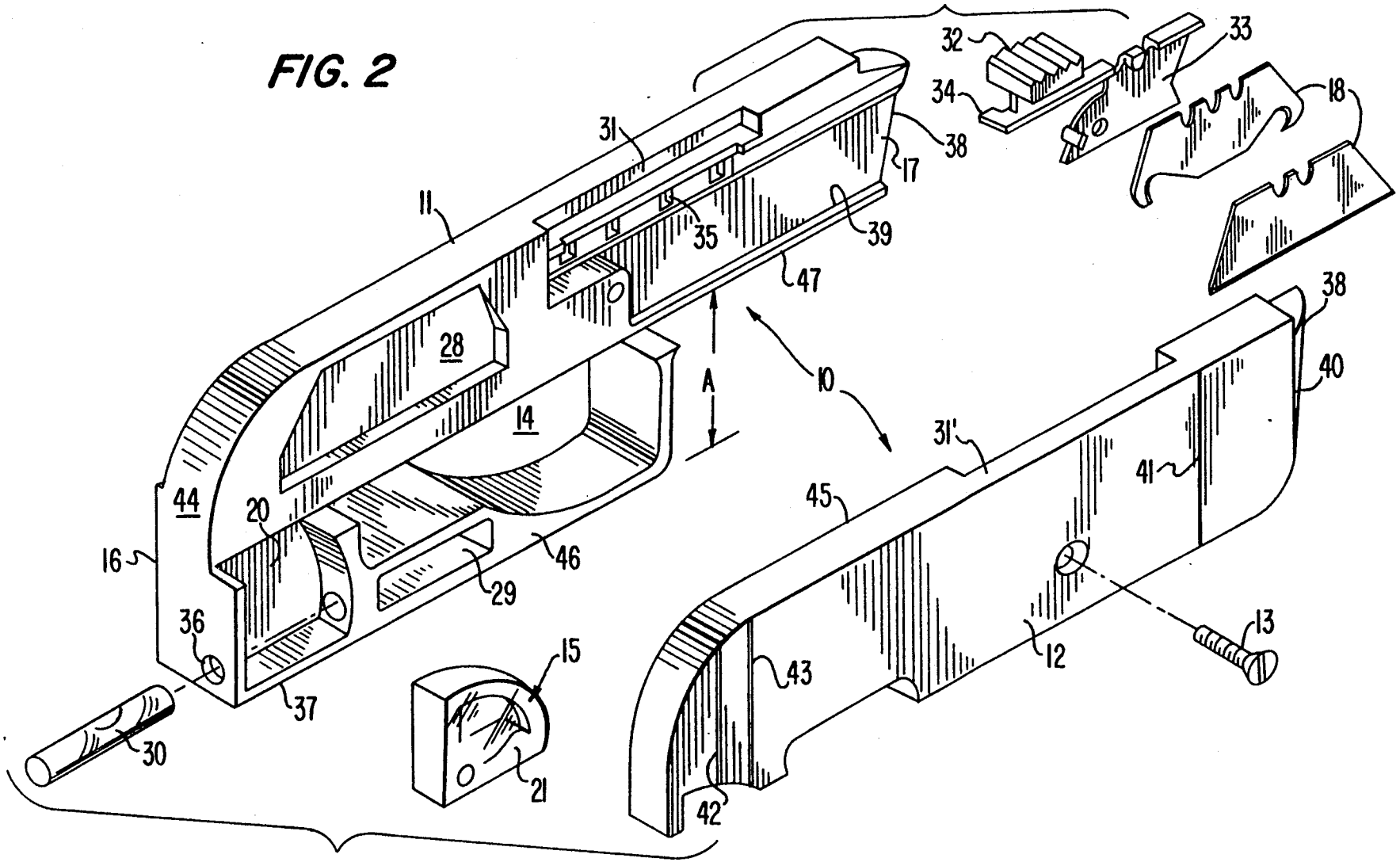
FIG. 2 is a perspective exploded view of the knife tool shown in FIG. 1.
Figure 4:
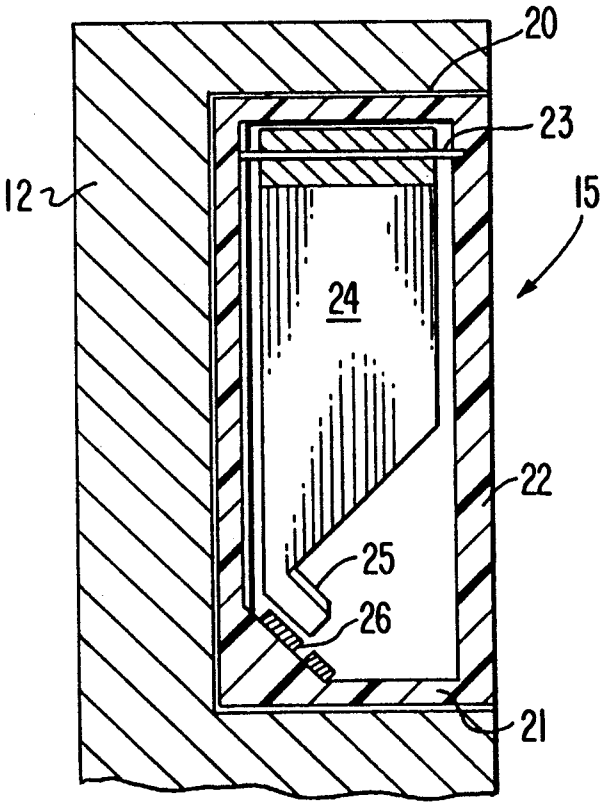
FIG. 4 is a side elevational view of the pitch gage shown in FIG. 3.

In order to assure that the shingles are applied with a uniform overhang, the portion 46 of the main body 11 defining the areas for the pitch gage receptacle 20, the finger slot 14 and the liquid level receptacle 29 is sized such that it has a width A sized so that, as shown in FIG. 5 when the base 37 of the main casing 11 is placed flat against a facia board a shingle S can be brought toward the tool 10 until the bottom edge contacts a surface 47 located below the blade end of the tool 10. Although the length of the overhang will vary slightly depending upon the pitch of the roof being installed, nevertheless the amount of overhang will be uniform by making two or more measurements at the rake end of the roof and two or more measurements on the long or eave side of the roof for each shingle in the starter course of shingles. If, for example, the general practice among roofing contractors and carpenters in a particular area is to have a one inch overhang, the width A of the member 46 is sized so that when the shingle is brought to the shingle edge stop 47 on the tool 10 there will be an approximately 1-inch overhang.

Figure 6:
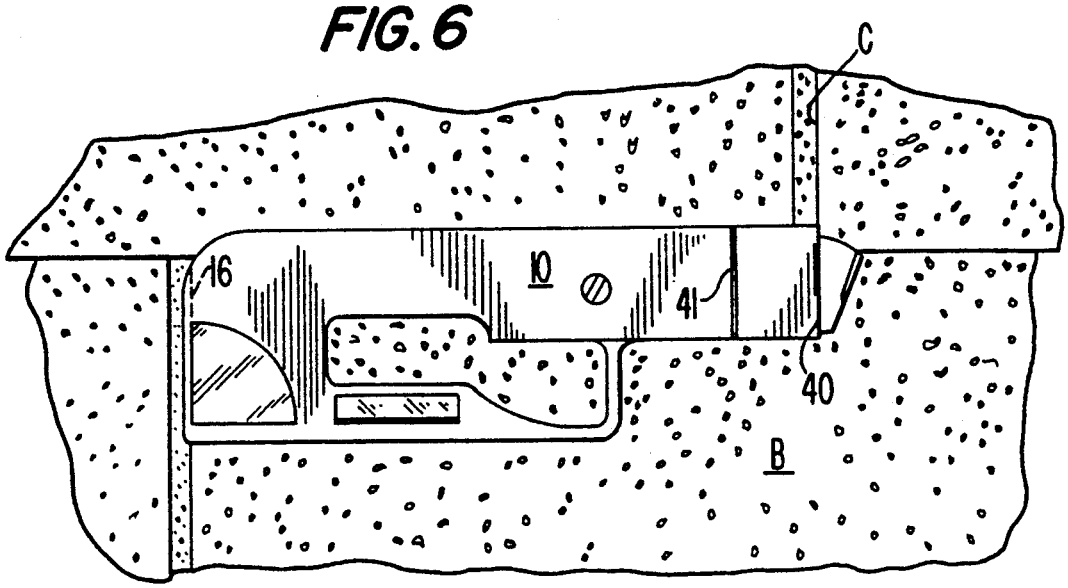

As shown in FIG. 6, the method for obtaining perfect vertical alignment of shingle tab slots after the first course has been laid is effected by using the starter course B as a guide. The lip 16 on the tool 10 is hooked on the left edge of the tab slot of the lower shingle S or the first course shingle. The next second course shingle is slid on top of the first course shingle until the left edge C of the second course shingle is aligned with the line 40 on the tool 10. This assures that the top shingle tab slot D will be perfectly centered on a bottom shingle.

Figure 7:
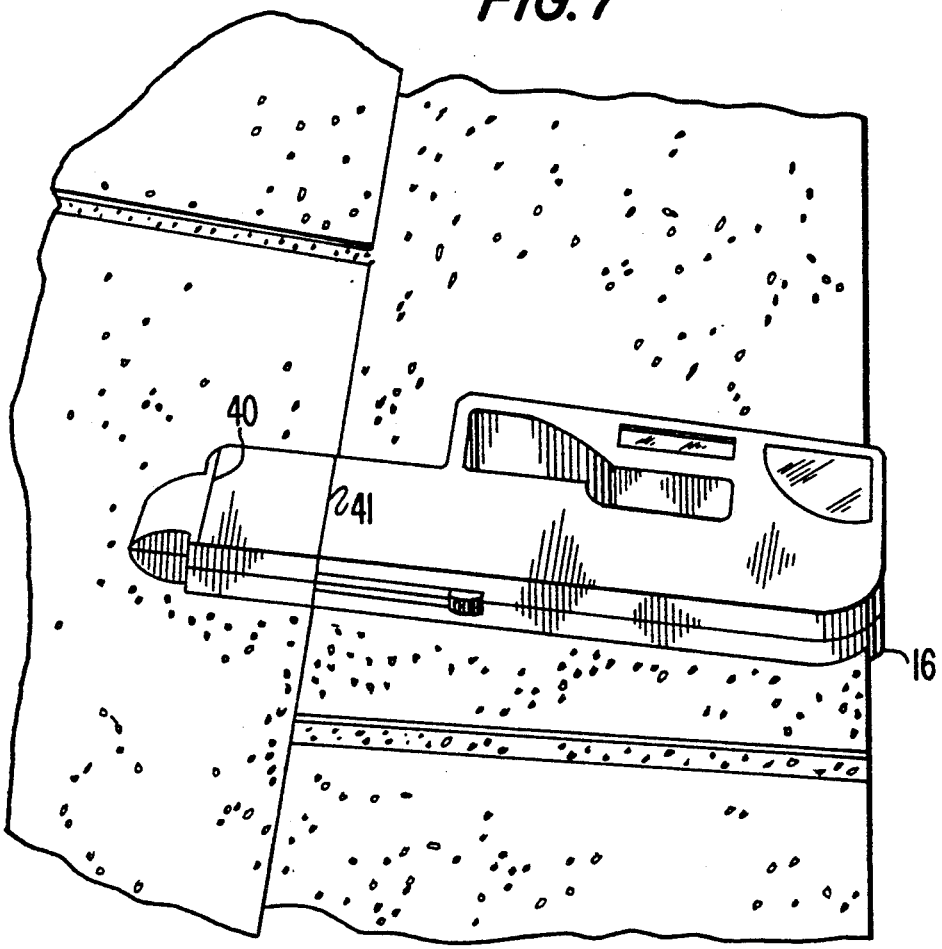
FIG. 7 is a schematic view illustrating how the knife tool of FIG. 1 is used to horizontally align each course of shingles.

To obtain perfect horizontal alignment of each course of shingles without the need for chalk lines, there is shown in FIG. 7 a method of using the tool 10 in which the lip 16 of the tool 10 is hooked on the bottom edge of the lower shingle so that the bottom edge of the next shingle in the next course is aligned with the line 41 on the tool 10.

Figure 8:
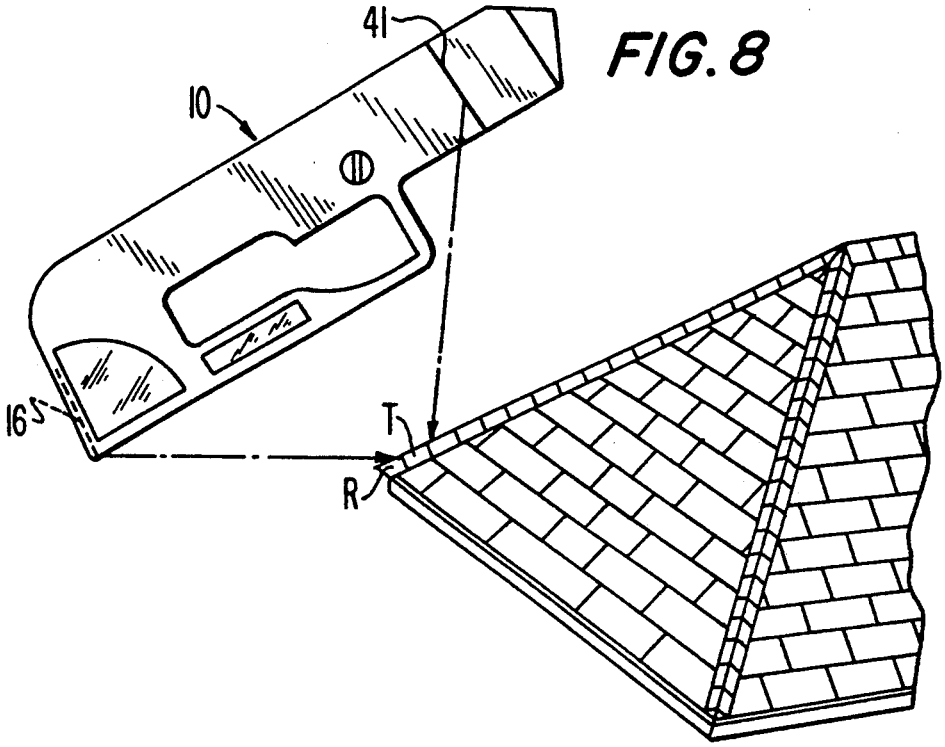
FIG. 8 is a schematic view illustrating how the knife tool of FIG. 1 is used to maintain a straight line of hip or ridge-lap shingles.

FIG. 8 shows a hip roof in which the tool 10 can be used to maintain a desired overlap and a perfectly straight run of hip or ridge-lap shingles. Specifically, after the first hip or ridge-lap shingle R has been centered and nailed in place, each succeeding shingle can have an exposed overlap of a certain amount, e.g. 5 inches, by hooking the lip 16 of the tool 10 on the bottom edge of the shingle T and aligning the bottom edge of both sides of the next shingle with the line 41. Again, this simple technique eliminates the need for a chalk line.

The finger slot 14 in the tool 10 allows the user to exert more uniform and constant pressure while cutting. As previously noted, the retractable cutting blade 18 is usable for purposes other than cutting shingles. It can be used for any job that requires a sharp blade, for example, cutting sheet rock, carpeting, wall paper, floor tile and the like.

Figure 9:
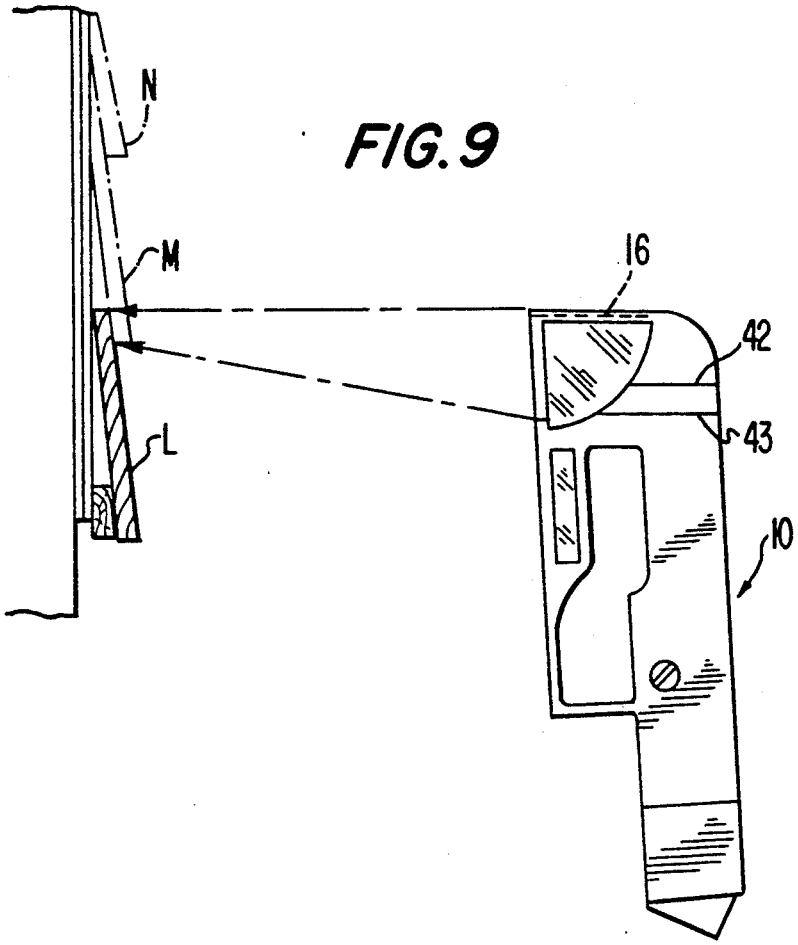
FIG. 9 is a schematic view illustrating how the knife tool of FIG. 1 is used to apply horizontal lap-siding.

Finally, FIG. 9 shows the method which can be used to apply horizontal lap-siding with the tool 10. As shown therein, each succeeding board 1, m, n, . . . overlaps a lower board by ¾ inch or 1 inch. By scribing or painting two lines 42, 43 on the tool, there is a means of measuring and marking the overlap required or desired. Then, after the first board 1 has been nailed in place, the lip 16 can be hooked on the top edge of the board 1 with the nose 38 pointing downward. That board can then be marked where the bottom edge of the next board is to be positioned using either the ¾ inch line 42 or the 1 inch line 43.

The liquid level 30 can be used in a conventional manner by placing the tool 10 on a surface (not shown) to read the extent to which the surface departs from the horizontal by the movement of the bubble in the liquid level in a known manner. Alternatively, the tool 10 can be placed on a longer straight edge and thereby used as a 2, 3 or 4 foot level.

While I have shown and described a presently preferred embodiment in accordance with the present invention, it is to be understood that the same is susceptible of changes and modifications as will be immediately apparent to one skilled in the art given the above disclosure. Therefore, I do not intend to be limited to the details shown and described herein but intend to cover all such changes and modifications as are encompassed by the scope of the appended claims.

I claim:

1. A tool, comprising a casing, a knife blade operatively associated with the casing and a pitch gage operatively associated with the casing and having means for directly reading vertical rise per standard horizontal distance wherein the pitch gage comprises a housing arranged in the casing, a pivot pin fixed in the housing, and a pendulum indicator freely rotatable about the pivot pin, and the direct reading means includes a scale graduated in amounts of vertical rise per horizontal distance and a pointer on the pendulum indicator to point to a discrete reading on the scale when the tool is positioned to take a pitch reading.

2. A tool according to claim 1, wherein means is provided for moving the knife blade relative to the casing and selectively fixing the knife blade at a desired position relative to the casing.

3. A tool according to claim 1, wherein the casing has a compartment for the storage of knife blades.

4. A tool comprising a casing, a knife blade operatively associated with the casing and a pitch gage operatively associated with the casing and having means for directly reading vertical rise per standard horizontal distance wherein the casing has a lip portion and markings on said casing to allow a user thereof to align a thing relative to another thing.

5. A tool according to claim 4, wherein the markings comprise a first straight line longitudinally spaced from the lip portion by a predetermined amount and proximate the knife blade.

6. A tool according to claim 5, wherein the markings comprise a second straight line longitudinally spaced from the lip portion by a predetermined amount and adjacent the first straight line.

7. A tool according to claim 4, wherein the markings comprise first and second straight lines longitudinally spaced from and proximate to the lip portion.

8. A tool according to claim 7, wherein the markings further comprise a third straight line longitudinally spaced from the lip portion by a predetermined amount and proximate the knife blade.

9. A tool according to claim 8, wherein the markings further comprise a fourth straight line longitudinally spaced from the lip portion by a predetermined amount and intermediate the second and third straight lines.

10. A tool according to claim 4, wherein the pitch gage comprises a housing arranged in the casing, a pivot pin fixed in the housing, and a pendulum indicator freely rotatable about the pivot pin, and the direct reading means includes a scale graduated in amounts of vertical rise per horizontal distance and a pointer on the pendulum indicator to point to a discrete reading on the scale when the tool is positioned to take a pitch reading.

11. A pitch gage, comprising a housing, a pivot pin operatively arranged in the housing, an indicator freely rotatable about the pivot pin, and a scale arranged on the housing so as to cooperate with the indicator when the housing is placed for making a pitch measurement and to provide a direct pitch reading of vertical rise per standard horizontal distance.

12. A pitch gage according to claim 11, wherein the indicator is provided with an arrow, and the scale has raised numbers with specific intervals of pitch shown by a numeral and the readings therebetween designed by lines.

13. A method for aligning shingles relative to each other, using a hand tool, comprising the steps of placing the hand tool against a facia board and moving each shingle in a first course of shingles into touching contact with the hand tool to provide a uniform shingle overhang;

hooking a lip portion of the hand tool at one side edge of each shingle in a previously laid course of shingles and aligning an edge of each shingle in a succeeding course of shingles with a first marking on the hand tool to obtain vertical alignment of tab slots between shingles and centering of the tab slots in the succeeding course of shingles with respect to the previously laid course of shingles; and hooking the lip portion of the hand tool at one long edge of each shingle in the previously laid course of shingles and aligning a long edge of each shingle in the succeeding course of shingles with a second marking on the hand tool to obtain horizontal alignment of each succeeding course of shingles with respect to the previously laid course of shingles.

14. A method for overlapping boards relative to each other using a hand tool, comprising placing a first board on a surface;

hooking a lip portion of the hand tool in at least one location on the edge of the first board so that the hand tool hangs vertically downward;

placing a second board on the surface with respect to a marking on the hand tool to obtain desired overlapping of the second board over the first board; and repeating the foregoing steps with respect to succeeding boards until a last board has been overlapped.

* * * * *